US011698238B2

(12) United States Patent
Prudent

(10) Patent No.: US 11,698,238 B2
(45) Date of Patent: Jul. 11, 2023

(54) SMART TRIGGER

(71) Applicant: SmartTrigger, LLC, Upper Marlboro, MD (US)

(72) Inventor: Brandon Alden Prudent, Seattle, WA (US)

(73) Assignee: SmartTrigger LLC, Upper Marlboro, MD (US)

( * ) Notice: Subject to any disclaimer, the term of this patent is extended or adjusted under 35 U.S.C. 154(b) by 0 days.

(21) Appl. No.: 17/739,750

(22) Filed: May 9, 2022

(65) Prior Publication Data

US 2022/0357123 A1 Nov. 10, 2022

Related U.S. Application Data

(60) Provisional application No. 63/186,787, filed on May 10, 2021.

(51) Int. Cl.
*F41A 19/58* (2006.01)

(52) U.S. Cl.
CPC ..... *F41A 19/58* (2013.01)

(58) Field of Classification Search
CPC ..... F41A 19/58; F41A 17/06; F41A 17/063; F41A 17/066; F41A 17/08; F41A 17/46
USPC ..... 89/135
See application file for complete search history.

(56) References Cited

U.S. PATENT DOCUMENTS

| | | | | |
|---|---|---|---|---|
| 6,321,478 | B1 * | 11/2001 | Klebes | F41A 19/58 42/70.11 |
| 8,375,838 | B2 * | 2/2013 | Rudakevych | F41H 7/005 89/27.11 |
| 9,127,909 | B2 * | 9/2015 | Ehrlich | G01C 3/08 |
| 9,473,712 | B2 | 10/2016 | McCloskey et al. | |
| 9,557,129 | B2 * | 1/2017 | Lupher | F41A 17/06 |
| 9,803,942 | B2 | 10/2017 | Milde, Jr. | |
| 9,958,228 | B2 * | 5/2018 | Stewart | F41A 19/01 |
| 10,001,335 | B2 * | 6/2018 | Patterson | F41A 19/58 |
| 10,097,764 | B2 * | 10/2018 | Ehrlich | F41G 3/06 |
| 10,175,018 | B1 | 1/2019 | Campagna et al. | |
| 10,365,057 | B2 | 7/2019 | Black et al. | |
| 10,378,845 | B2 * | 8/2019 | Nakamura | F41A 17/06 |
| 10,900,754 | B1 * | 1/2021 | Basche | F41G 9/00 |

(Continued)

FOREIGN PATENT DOCUMENTS

| | | | |
|---|---|---|---|
| EP | 2613117 | A2 | 10/2013 |
| KR | 20180067815 | A | 6/2018 |
| WO | 2020201787 | A1 | 10/2020 |

*Primary Examiner* — Joshua E Freeman
*Assistant Examiner* — Benjamin S Gomberg
(74) *Attorney, Agent, or Firm* — Bold IP, PLLC; Binita Singh

(57) ABSTRACT

A system and method for a programmable trigger device for a firearm, capable of situational awareness providing intelligent contextual data related to projectile management to a downstream firing device. In particular, a smart trigger system that evaluates targets in line-of-fire, estimated target age, estimated target distance, and other contextual data that is then passed along to a programmable device. The device, as provided by the consumer of this invention, may make the determination then whether to eject or prevent ejection of a bullet after the trigger is activated, firing an alternative shot based on environmental factors of which the device is aware, or other activations or deactivations as seen fit.

19 Claims, 7 Drawing Sheets

(56) References Cited

U.S. PATENT DOCUMENTS

| | | | | |
|---|---|---|---|---|
| 2013/0167423 | A1* | 7/2013 | Lupher | F41A 19/42<br>42/70.06 |
| 2015/0211828 | A1* | 7/2015 | Lupher | F41A 17/06<br>42/69.01 |
| 2017/0286762 | A1* | 10/2017 | Rivera | G08B 13/19684 |
| 2019/0271516 | A1 | 9/2019 | Emas | |
| 2020/0232737 | A1* | 7/2020 | McClellan | F41A 17/08 |
| 2023/0037964 | A1* | 2/2023 | Mann | F41A 17/063 |

* cited by examiner

Basic Data Flow

Variables

| Variable Name | Data Type | Description |
|---|---|---|
| HumansCount | Integer | Provides the estimated number of humans visible to the device |
| Target | Complex | Provides complex data about the specific target(s) within the line-of-fire |
| IsHuman | Boolean | True if the target is likely human |
| Age | Integer | The estimated age of The target or null if non-human |
| BodyPart | String | The targeted body part or null if non-human |
| Distance | Float | The estimated distance, in meters, the target is from the device |

FIG. 3

SMART TRIGGER

CROSS REFERENCE TO RELATED APPLICATIONS

This application is a non-provisional application which claims priority to U.S. Provisional Patent Application No. 63/186,787 filed on May 10, 2021, and which is incorporated by reference in its entirety.

FIELD OF DISCLOSURE

The present invention relates to a programmable trigger device for a firearm capable of situational awareness providing intelligent contextual data related to projectile management to a downstream firing device.

BACKGROUND

Gun violence, as the name suggests, is violence committed with the use of a gun. Gun related violence may be found in many situations including intentional homicide, suicide, domestic violence, robbery, assault, police shootings, self-defense, and accidental shootings. Gun violence almost always involves a gunshot wound which is a physical trauma to a person's body. Gunshot injuries to some of the vital organs like the heart, lungs, liver, and the brain can have devastating effects which can lead to death. In such cases, a shot to any of these body parts may be referred to as a fatal shot which leads to death.

Firearms are the leading cause of death for American children and teens. Women in the U.S. are 28 times more likely to be killed by guns than women in other high-income countries. More than 2,100 children and teens die by gun homicide every year. For children under the age of 13, these gun homicides most frequently occur in the home and are often connected to domestic or family violence.

Worldwide, guns wound or kill millions of people. Unfortunately, gun violence is a leading contributor of deaths in the United States. As of 2017, it is the leading cause of traumatic death. In the United States, legislation at all levels has attempted to address gun violence through a variety of methods, including restricting firearms purchases by certain populations, setting waiting periods for firearm purchases, law enforcement and policing strategies, stiff sentencing of gun law violators, education programs for parents and children, and community-outreach programs. There are also many firearm safety devices designed to prevent unwanted or accidental shooting of firearms. Examples of such systems include keyed locks or biometric locks, wherein a trigger on a gun cannot be pulled until an authorized user inserts a key or the biometric system recognizes a fingerprint to unlock the trigger.

Thus, there is an increasing need for technology solutions to curb gun violence and reduce overall fatalities.

SUMMARY

The present disclosure describes a programmable trigger mechanism that may be used with any direct fire device designed with the purpose of aiming and firing a projectile. Direct fire refers to a firing of a ranged weapon whose projectile is launched directly at a target within the line-of-sight of a firing device. Examples of direct fire weapons include and are not limited to handguns, rifles, machine guns, bows, and howitzers. Throughout this disclosure, embodiments of a smart trigger system will be described to illustrate the functionality and purpose of the smart trigger system.

The smart trigger system may be described as a system whereby an electronic mechanism is able to accept environmental input from one or more environmental input devices such as, and not limited to, a camera and a sensor device. The received environmental input may be inferred via machine learning to provide quickly accessible data regarding the situation around the firing device. The smart trigger mechanism may be permanently affixed to any device that is generally designed to aim and fire. The smart trigger may be affixed to a firing device wherein an activation signal will be triggered to commence with the receiving of the environmental input, evaluation of the input, and the programmed output. A computing device may receive the activation signal and upon receipt, the computing device and an accompanying governing software will be responsible for brokering data between subsystems such as the control system and an activation system. Specifically, the governing software will work in conjunction with an operating system of the computing device to run an activation function when an electronic signal is made.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

FIG. 3 is a table of non-exhaustive variables made available to the device consumer

DETAILED DESCRIPTION

Figure 1:
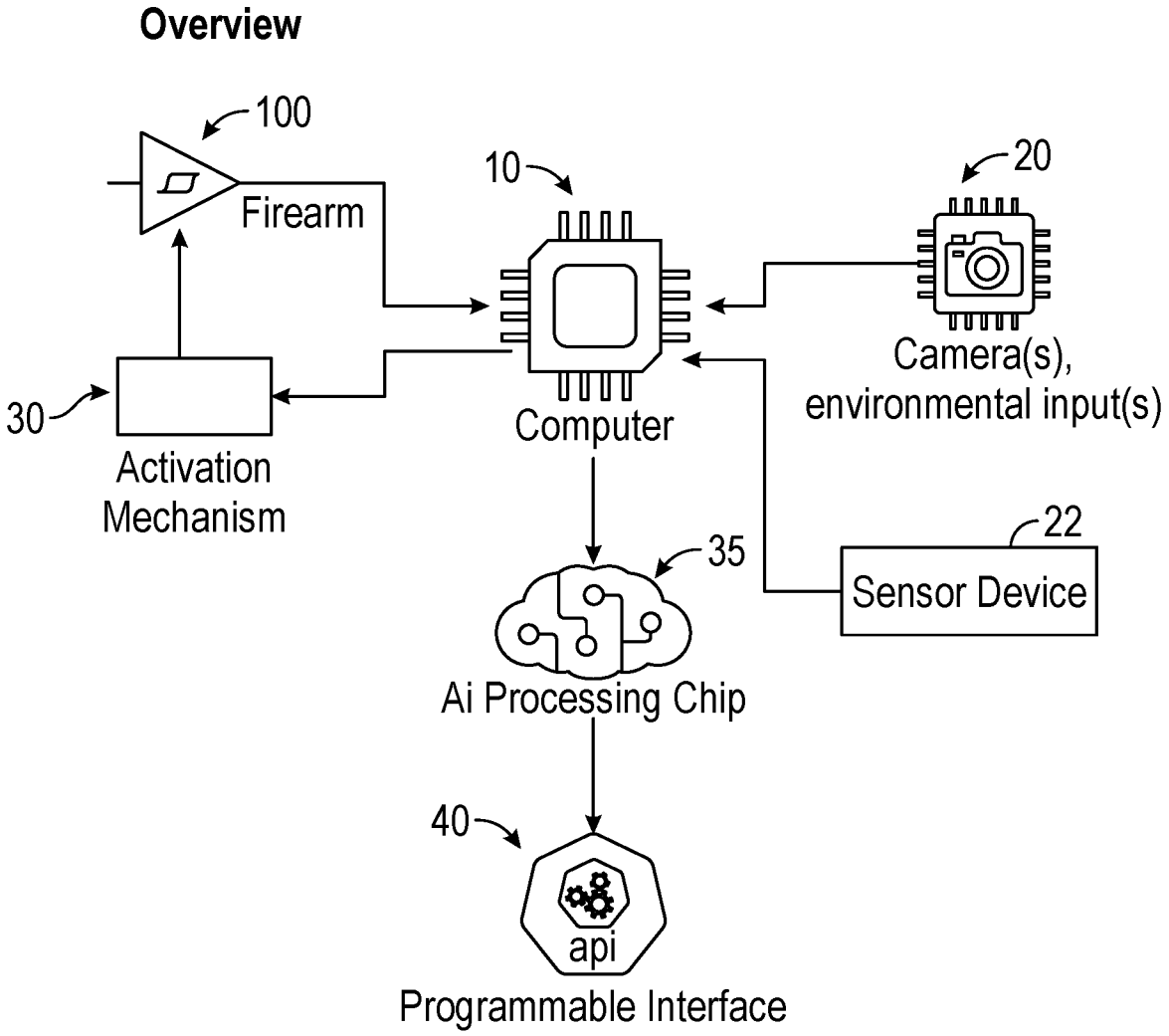
FIG. 1 is an overview block diagram of the basic elements comprising the smart trigger system.

In the Summary above and in this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" may be used herein to mean "serving as an example, instance, or illustration." Any aspect described in this document as "exemplary" may not be necessarily construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The invention described herein provides for a trigger mechanism which is capable of learning and evaluating multiple inputs and targets, then relaying the output of the evaluation into a real-world situation with a firearm. The system itself is intended to be installed on a firearm during manufacturing of the firearm or post manufacturing by a person skilled in the art. This invention can serve as the platform for ushering in a new era of smart gun technology.

The present disclosure describes a programmable trigger mechanism that may be used with any direct fire device designed with the purpose of aiming and firing a projectile. Direct fire refers to a firing of a ranged weapon whose projectile is launched directly at a target within the line-of-sight of a firing device. Examples of direct fire weapons include and are not limited to handguns, rifles, machine guns, bows, and howitzers. Throughout this disclosure, embodiments of a smart trigger system will be described to illustrate the functionality and purpose of the smart trigger system.

The smart trigger system may be described as a firearm component which is a system whereby an electronic mechanism is able to accept environmental input from one or more environmental input devices such as, and not limited to, a camera. The received environmental input may be inferred via machine learning to provide quickly accessible data regarding the situation around the firing device. Machine learning inference may happen on a special purpose chip such as, and not limited to, Google's Coral AI chips and any that may be used in the future. The smart trigger mechanism may be permanently affixed to any device that is generally designed to aim and fire. One example of an application of this system would be with use of an actual firearm, wherein the smart trigger may be used to prevent firing a shot towards any human with the goal of reducing unintended fatalities. This device may be used at shooting ranges, gun safety trainings, in hunting circumstances, or any other setting in which humans should not be the target of a firearm.

The smart trigger may be affixed to a firing device wherein an activation signal will be triggered to commence with the receiving of the environmental input, evaluation of the input, and the programmed output. As an example, a positive five-volt charge may be sent to the system as the activation signal. The activation signal may be conceptualized as a basic General-Purpose Input/Output (GPIO) pin. A computing device may monitor this activation pin for the +5V signal.

Upon receipt of the activation signal, the computing device and accompanying governing software will be responsible for brokering data between subsystems such as the control system and activation system. Specifically, the governing software will work in conjunction with an onboard operating system to run an activation function each time a +5V electronic signal is made, which will be discussed later in the Detailed Description.

The computing device is meant generically to represent a functioning computer having RAM, on-device storage, removable media (SD card or similar), a GPIO pin, and an operating system running the smart trigger governing program. The governing program receives a signal from the GPIO pin (the activation signal) before running a function whose purpose is to gather the environmental inputs from one or more environmental input devices, run a model inference based on the machine learning via the special purpose chip, and finally building a variable table that can be analyzed through an interface. In one non-limiting embodiment, the variable table would show variables available from the programmable interface which users can use to make best-case determinations for their own products. One embodiment of a variable table is illustrated in FIG. 3

The present disclosure would incorporate the artificial intelligence (AI) chip for data analysis. The models used may include, and not be limited to, some form of neural network whether it be Residual Neural Networks (ResNets), Convolutional Neural Networks (CNN), or other industry standard models and algorithms of machine learning used now or that may be used in the future. These models will be trained ahead of time by analyzing previous images and videos to estimate various data points as listed, but not limited to, the variable table in FIG. 3.

One or more embodiments of the smart trigger system may comprise of a trigger mechanism, a computing device, one or more cameras, one or more sensor devices, and a programmable interface which is intended to be connected to any firearm discharge mechanism. The smart trigger activation mechanism is expected to be connected via a five volt positive signal connected to a triggering mechanism such as found on a standard firearm. Upon this activation signal, the input camera (along with any other connected inputs) should send their data through to the machine learning models. Additionally, the camera may be mounted on the firearm in a position to capture a line of sight of the firearm, which would include data related to an image in the possible line of fire.

The data from the camera is sent to the computing device which may comprise of one or more processors to process and evaluate the image(s) or video. The data, in the form of video or image(s), sent from the camera will be evaluated based on the visual inputs that were used to train the system. The evaluation data may be sent to the programmable interface. This will result in the discharge mechanism completing the operation the device was programmed for such as firing of a shot or preventing firing of a shot, firing an alternative shot wherein an alternative shot may be a non-lethal round, or any other operation deemed necessary at the time of device programming. The smart trigger system may also comprise of the one or more sensors which may also send data to the computing device to be processed and evaluated and used in conjunction with the data collected from one or more cameras. The sensor(s) may collect data such as and not be limited to distance from sensor to target.

Sensors may be any type of sensor or combinations thereof. Examples of sensors may include cameras, pressure sensors, GPS, LIDAR systems, Local Positioning System (LPS), altimeters which can identify where the user is located in a space, and motion sensors (e.g., accelerometers) which can generate data associated with the orientation of the smart trigger system or if the smart trigger system is facing or moving in a specific direction. The sensors may be affixed with adhesive to the smart trigger system or otherwise connected to the smart trigger system. In one or more embodiments, activation or deactivation of the discharge mechanism may differ depending on a received GPS location.

Sensors may have infrared ("IR") detectors having photodiode and related amplification and detection circuitry. In one or more non-limiting alternate embodiments, radio frequencies, magnetic fields, and ultrasonic sensors and transducers may be employed. Sensors may be arranged in any number of configurations and arrangements. Sensors may be configured to send and receive information over a network, such as satellite GPS location data, audio, video, and time.

In some embodiments, a night vision flashlight is coupled with the camera such that the camera may capture a clear image or video of a target in low light conditions. In some embodiments, the camera may be a still camera or a video camera. It is also to be contemplated that any camera that may be known or be created in the future that would be beneficial to a system such as the one described herein may comprise part of the safety system.

The smart trigger system may receive content input sources including those intimated in the aforementioned description whereby smart trigger system may begin image processing on the content received.

In one or more non-limiting embodiments, the AI processing chip may use Optical Character Recognition (OCR) technology that may detect and recognize one or more type of objects from the images and videos received. For example, in some embodiments, OCR involves identifying the presence, location, and type of one or more objects in a given image or video.

Artificial Intelligence Chip 35 may use machine learning and may perform detection processes for different types of content, including, audio, video, text, or other identifying objects collected from the content.

Data collected from the output of the machine learning models is collected as a series of variables as described in FIG. 3. This data may be made available to the consumer in an industry-standard and appropriate manner. Specifically, the consumer may build an application that is capable of being invoked by the smart trigger system, can read the inbound data, and is capable of transforming these smart trigger outputs into real-world scenarios as deemed fit by the consumer. In further non-limiting embodiments, this may be already created or predesigned suitably for the consumer. Collectively this functionality is referred to as the 'programmable interface' of the system.

Consumers may program their own system. In one non-limiting embodiment, a user may extract the removable media then copy their program to the root of the ext4-formatted filesystem on the media. The name of the file must be 'interface' without any extension and the file be granted executable permission. The program may be one of Python3.9, Bash 3+, or any ELF-compiled binary that does not require a runtime or includes a runtime itself. Once the program is loaded to specification on the removable media, the media must be put back into the device for usage.

The smart trigger system may separate the foreground from the background to identify more objects and their correlation to one another. The smart trigger system may utilize background segmentation, noise filtering, as well as foreground segmentation into regions of interests, such as those containing moving objects. In one or more non-limiting embodiments, the smart trigger system may calculate a reference reflectance characteristic for a subject profile and for each region not intersecting a determined subject profile, calculating a reflectance characteristic.

The non-intersecting region reflectance characteristic may then be compared with the reference reflectance characteristic. A non-intersecting region may be designated as foreground when the non-intersecting region reflectance characteristic is determined to be within a threshold of the reference reflectance characteristic and designated as a background when the non-intersecting region reflectance characteristic is determined to be outside a threshold of the reference reflectance characteristic. Determination of foreground and background may also be calculated by any other method known by those of ordinary skill in the art such that content processing module can identify objects in the foreground and the background.

FIG. 1 illustrates a block diagram of the smart trigger system, according to one or more embodiments of the invention. As described above, the smart trigger system is one example of a system coupled to a device and is not intended to limit it in any way. Referring back to the example in FIG. 1, in one or more embodiments, the smart trigger system may be installed on any firearm or other weapon such as a taser (See, FIG. 1, Firearm 100). The smart trigger system may be used to inform a discharge mechanism whether to fire or not to fire after a trigger mechanism has been activated (i.e., trigger is pulled). As illustrated in the block diagram, the smart trigger system may include a computing device 10, one or more cameras, such as camera 20, a sensor device 22, an activation mechanism 30, and a programmable interface 40. The computing device 10, the camera 20, the sensor device 22, an AI processing chip 35, the activation mechanism 30, and the programmable interface 40 may be provided on a firearm or a separate remote device. The smart trigger system may also include one or more machine learning systems or algorithms wherein one or more images are combined and used to train the smart trigger system during a training mode.

The computing device 10 and the various exemplary components that may be employed in practicing one or more non-limiting embodiments of the invention are included. The computing device 10 may be any type of small computing device known or to be created in the future that can be installed on a firearm. This may include and not be limited to computing devices that may be found on mobile devices such as smart phones, smart watches, or any other type of mobile, electronic computing device. The computing device 10 may be retrofitted on to a firearm with an electronic trigger. It is also to be understood that the firearm may be manufactured with the smart trigger system.

Figure 5:
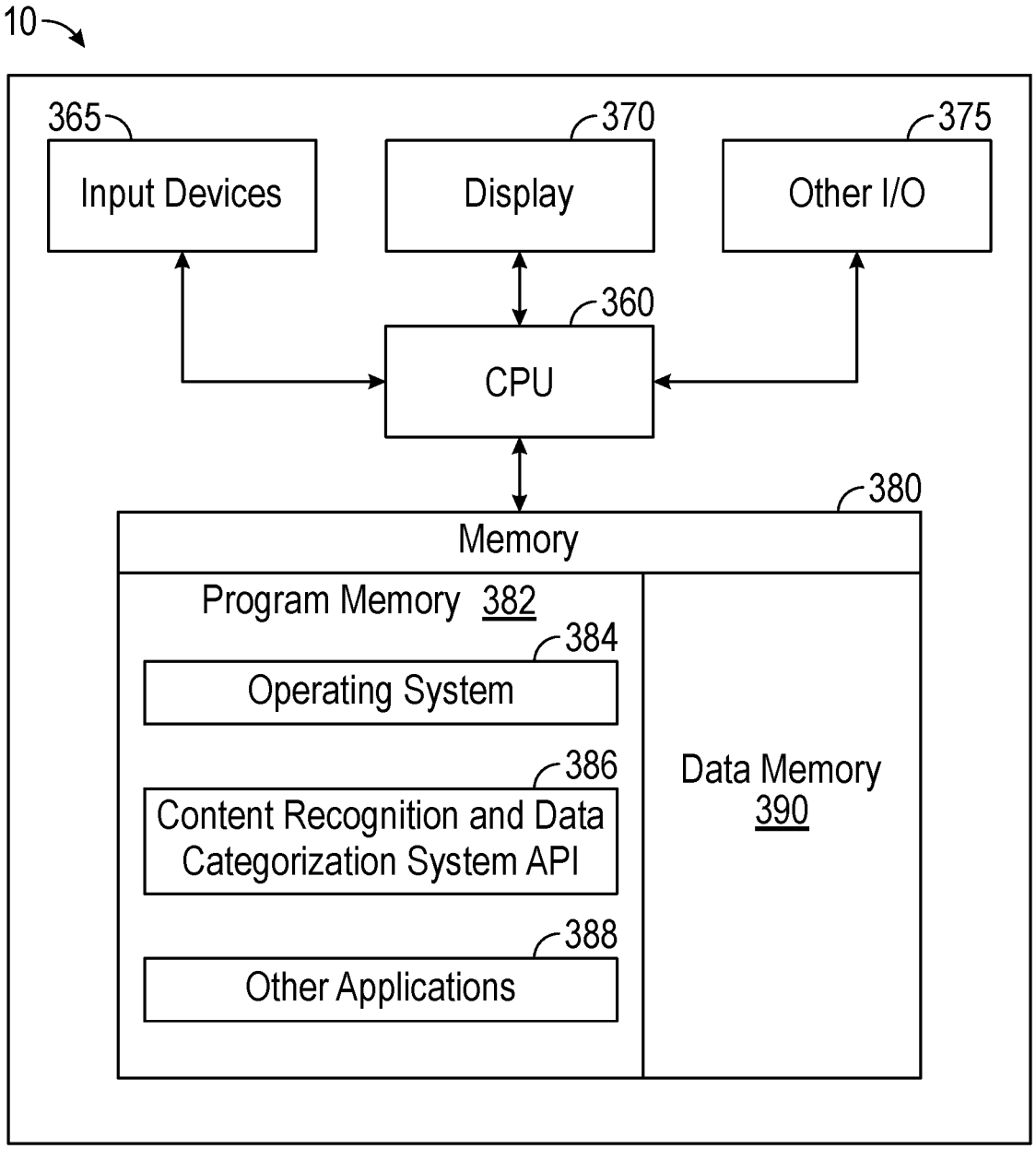
FIG. 5 illustrates an example of a computing device.

One or more embodiments of computing device 10 are further detailed in FIG. 5. Computing device 10 may comprise hardware components that allow access to edit and query the smart trigger system. Computing device 10 may include one or more input devices such as input devices 365 that provide input to a CPU (processor) such as CPU 360 notifying it of actions. The actions may be mediated by a hardware controller that interprets the signals received from input devices 365 and communicates the information to CPU 360 using a communication protocol. Input devices 365 may include but are not limited to a mouse, a keyboard, a touchscreen, an infrared sensor, a touchpad, a wearable input device, a camera- or image-based input device, a microphone, or other user input devices known by those of ordinary skill in the art.

CPU 360 may be a single processing unit or multiple processing units in a device or distributed across multiple devices. CPU 360 may be coupled to other hardware devices, such as one or more memory devices with the use of a bus, such as a PCI bus or SCSI bus. CPU 360 may communicate with a hardware controller for devices, such as for a display 370. Display 370 may be used to display text and graphics. In some examples, display 370 provides graphical and textual visual feedback to a user.

In one or more implementations, display 370 may include an input device 365 as part of display 370, such as when input device 365 is a touchscreen or is equipped with an eye direction monitoring system. In some implementations, display 370 is separate from input device 365. Examples of display 370 include but are not limited to: an LCD display screen, an LED display screen, a projected, holographic, virtual reality display, or augmented reality display (such as a heads-up display device or a head-mounted device). Other I/O devices such as I/O devices 375 may also be coupled to the processor such as a network card, video card, audio card, USB, FireWire, or other external device.

CPU 360 may have access to a memory such as memory 380. Memory 380 may include one or more of various hardware devices for volatile and non-volatile storage and may include both read-only and writable memory. For example, memory 380 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory 380 is not a propagating signal divorced from underlying hardware; a memory is thus non-transitory.

Memory 380 may include program memory such as program memory 382 capable of storing programs and software including operating systems such as operating system 384, API such as Content Recognition and Data Categorization system API 386, and other computerized programs or application programs such as application programs 388. Memory 380 may also include data memory such as data memory 390 that may include database query results, configuration data, settings, user options or preferences, etc., which may be provided to program memory 382 or any element of computing device 10.

The smart trigger system may be trained, during the machine learning mode, with images of humans of various age, at various distance, in variable numbers as a means to an estimated output by the inferred model. For example, the computing device 10 of the smart trigger system may be trained with images of body parts wherein the images are annotated as parts of the body that may fall under fatal shots and parts of the body that may fall under non-fatal shots. For example, in the machine learning process, the smart trigger system may be fed with images of the head and chest wherein these images are annotated as body parts leading to fatal shots. The computing device 10 of the smart trigger may also be trained with other objects that are similar to live humans or their body parts such as billboards, posters, and signs.

A processing unit in the computing device 10, such as the CPU 360 in FIG. 5, processes the images captured by the camera 20 and processes the data from the one or more sensors 22 on the firearm. The CPU 360 feeds the image(s) sent by the one or more sensors 22 through the machine learning model(s) running at the AI processing chip 35. The model outputs will be coalesced into meaningful output variables in the programmable interface 40. The processing unit may be a part of a control system for communicating with various components of smart trigger system.

The control system may operate to control the actuation of the other components such as activation mechanism 30. The control system may have a series of computing devices. The control system may be in the form of a circuit board, a memory, or other non-transient storage medium in which computer-readable coded instructions are stored and one or more processors configured to execute the instructions stored in the memory. The control system may have a wireless transmitter, a wireless receiver, and a related computer process executing on the processors.

Computing device 10 may be integrated into the control system, while in other non-limiting embodiments, the control system may be a remotely located computing device or server configured to communicate with one or more other control systems. The control system may also include an internet connection, network connection, and/or other wired or wireless means of communication (e.g., LAN, etc.) to interact with other components. The connection allows a user to update, control, send/retrieve information, monitor, or otherwise interact passively or actively with the control system.

The control system may include control circuitry and one or more microprocessors or controllers acting as a servo control mechanism capable of receiving input from sensors 22 and other components, analyzing the input from sensors 22 and other components, and generating an output signal to components. The microprocessors may have on-board memory to control the power that is applied to the various systems. The control system may be preprogrammed with any reference values by any combination of hardwiring, software, or firmware to implement various operational modes including but not limited to temperature, light, and humidity values.

The microprocessors in the control system may also monitor the current state of circuitry within the control system to determine the specific mode of operation chosen by the user. Further, such microprocessors that may be part of the control system may receive signals from any of or all systems. Such systems may be notified whether any of the components in the various systems need to be replaced.

The activation mechanism 30 may be a positive five volt signal generally connected via an electronic trigger (not shown). Generally, an electronic trigger uses an electric signal to fire a cartridge instead of a centerfire primer or rimfire primer. Most firearms, which do not have an electronic trigger, use a mechanical action which entails a firing pin and primer to ignite a propellant in the cartridge which propels a bullet forward. An electronic trigger uses an electric signal instead of a conventional mechanical action to ignite the propellant which fires the projectile. In one or more embodiments described herein, the trigger mechanism 30 is activated when the electronic trigger is pulled, wherein the electronic trigger communicates with the computing device 10 which subsequently processes the one or more images captured by the camera 20 and simultaneously process the sensor data from the one or more sensors 22 and evaluates the processed image(s) and the sensor data with the trained data fed during the machine learning stage in real time. The resulting data is sent to the programmable interface 40 for implementation-dependent processing. In some examples, this may send a signal to the discharge mechanism to complete the firing or not.

Figure 2:
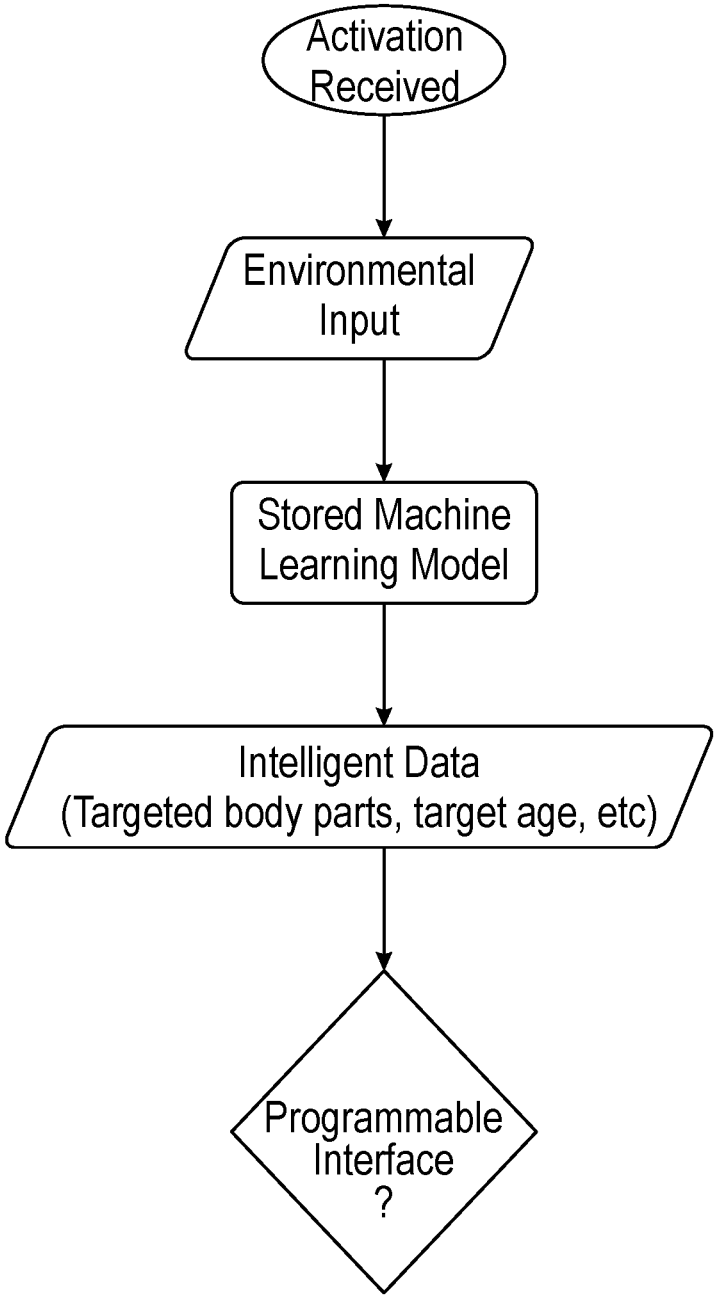
FIG. 2 is a data flow diagram at a high level from activation to the final output—a programmable interface

FIG. 2 illustrates a data flow diagram of a smart trigger system consistent with various embodiments. At block 100, a trigger mechanism (e.g., trigger mechanism 30) is activated. Using an example of a firearm, the activation may basically be the pressure applied on a trigger to fire a firearm. The trigger mechanism 30 activation communicates with the computing device 10 that the trigger to the firearm, to which the smart trigger system is connected to, has been pulled.

Next, at block 102 the camera 20 connected to the computing device 10 captures one or more images of the target. The camera 20 is positioned such that it is facing the front and generally in line with a barrel of the firearm to capture the target image in line with the intended (or unintended) direction of a shot to be fired. Simultaneously, the one or more sensors 22 also collect data which may also be positioned on the firearm in line with the intended (or unintended) direction of the shot to be fired. The one or more images and sensor data are sent to the processing unit in the computing device 10.

Next, at block 104, the processing unit in the computing device 10 processes the one or more images and sensor data captured by the camera 20 and the sensor 22 whereby camera 20 may also be included as a sensor 22. The one or more images undergo a series of transformations in line with the original training of the stored machine learning model to prepare the image(s) for evaluation with the trained data.

At block 106, the processing unit starts evaluating the one or more images processed in conjunction with the sensor data at block 104. The one or more images are compared with the trained data from the machine learning stage to determine or predict the outcome as to whether the processed image is more likely than not to be hit with a bullet exiting the firearm from which the trigger mechanism 30 was activated. The evaluation phase will also determine whether this target, based on the trained data, is a target that can be shot at or not be shot at.

Next, at block 108, the processing unit in the computing device 10 generates a signal based on the imaging processing results from block 106 and sends the signal to the discharge mechanism to determine whether to either proceed with firing the bullet from the firearm or prevent the completion of the bullet from being fired.

At block 110*a*, the discharge mechanism is activated, wherein the smart trigger system determined that the target in line with the projected path of the shot is a target that may be shot at. On the other hand, at block 110*b*, the discharge mechanism is prevented from completing the firing of the shot, as it was determined that the target in line with the projected path of the shot is a target that should not be shot at.

Thus, the smart trigger system as described above is an electronic mechanism which may be configured onto any firearm accepting electronic input or adapter system for mechanical firing. The smart trigger system is trained through machine learning to make a determination whether to fire or not to fire when it detects a certain target in the line of fire. An example of which is described above is to prevent a fatal shot to a person (a target). In the case of shootings, such as police shootings or self-defense shootings, a shot to a part of the body that may be considered fatal is not necessary and, in most cases, may be unintended. In such a case, the goal is not to prevent a shot from being fired but to prevent a shot to a person's body that may be considered fatal (i.e., head and chest) and may vastly reduce the number of unintended fatalities.

FIG. 3 illustrates the variables central to the programmable interface. Specifically, this is the data that is meant to be passed to a consumer application so a consumer can make device determinations specific and applicable to situations as they see fit. Consumers may provide a compatible application, to be invoked with an argument pointing to a memory-mapped file containing these variables. The format of the memory mapped file may be shared with consumers at the time of integration.

Figure 4:
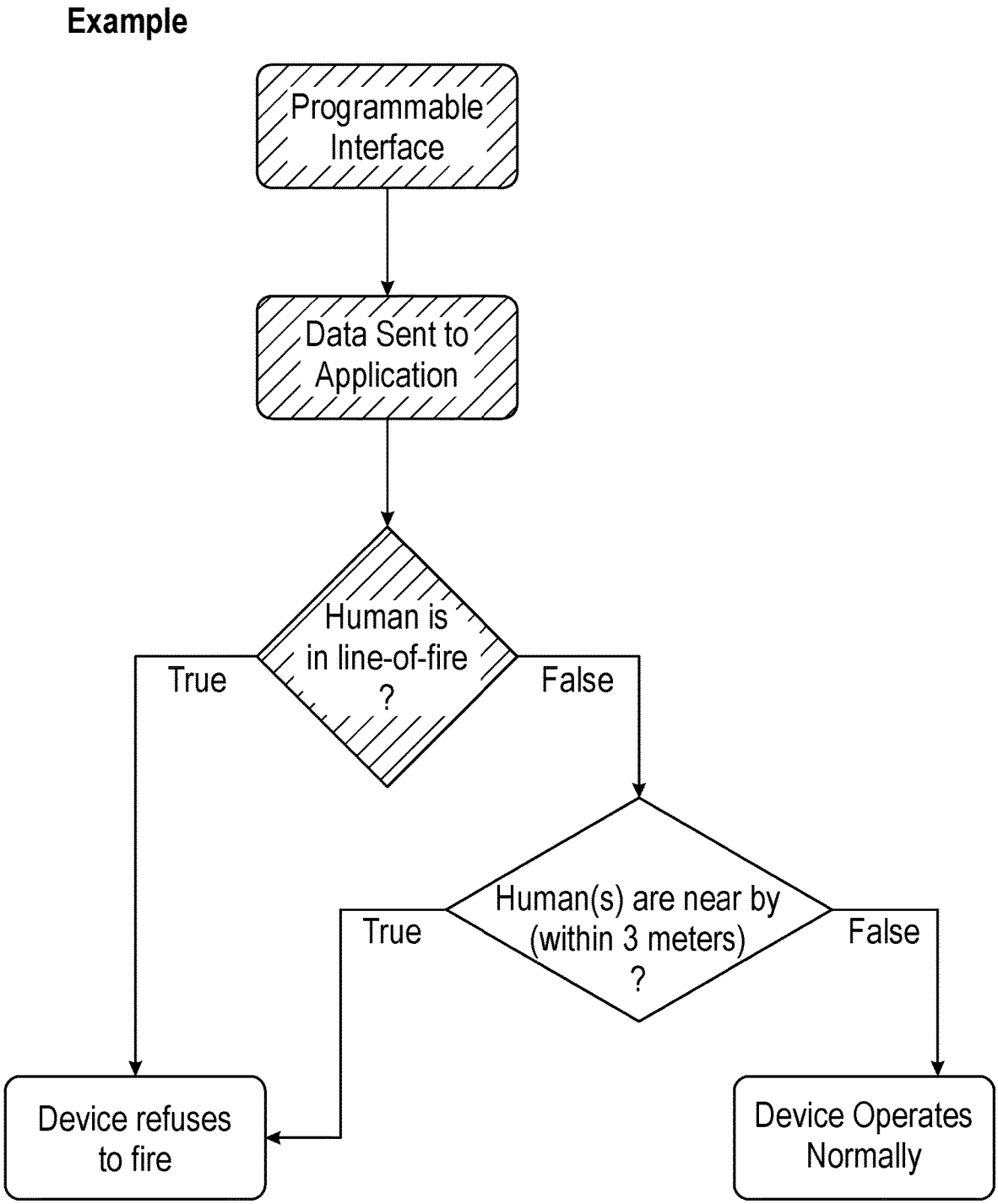
FIG. 4 is an example implementation of a consumer application interfacing with the invention via the programmable interface.

FIG. 4 represents an example program flow a consumer of this technology may use to prevent humans from being targeted by the affixed weapon. This configuration would be a good fit for firearm safety cases such as training, target practice, and hunting where the intended target is not human. In this configuration, the consumer's program is invoked by the programmable interface after activation and with the variables defined from FIG. 3. Data is read by the application to make the following determination; if a human is in the line-of-fire the appropriate mechanisms are invoked that would fully arrest the firearm from discharge. In the case one or more human minor(s) are not in the line-of-fire but within an estimated 3 meters from the firing device the device will again refuse to fire. Assuming these conditions are not met, the device will be free to operate normally and eject a projectile as intended.

Figure 6:
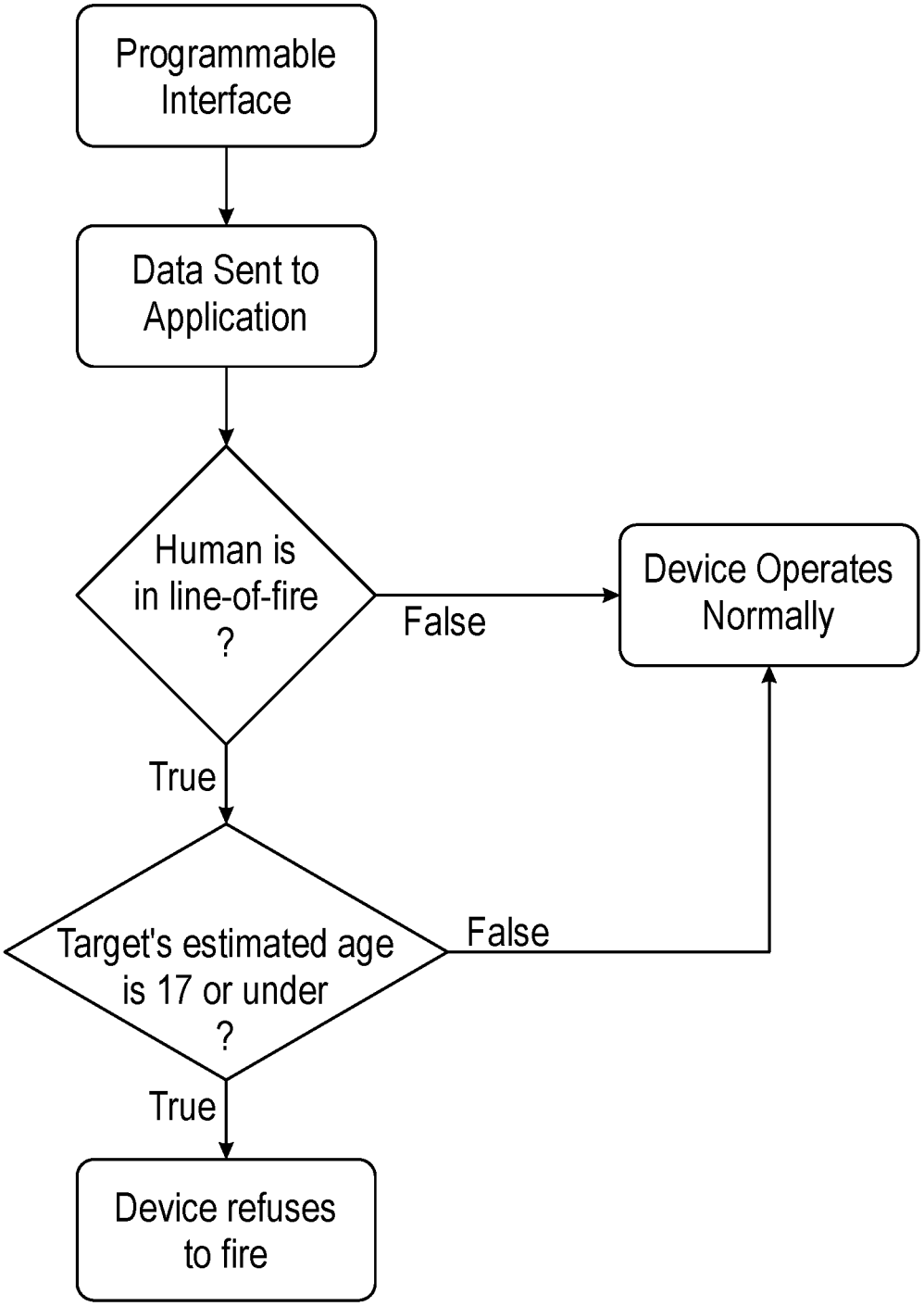
FIG. 6 is an example flowchart for implementation of a consumer application interfacing with the invention via the programmable interface for identifying a minor.

FIG. 6 represents an example program flow a consumer of this technology may use with the smart trigger. In this example, the goal of the user or consumer is to refuse to fire a weapon against minors. The user of the smart trigger technology is checking if a human is in the line-of-fire given this shot's activation. In this configuration, the consumer's program is invoked by the programmable interface after activation and with the variables defined from FIG. 3. Data is read by the application to make the following determination; if a human minor is in the line-of-fire the appropriate mechanisms are invoked that would fully arrest the firearm from discharge. In the case one or more human minor(s) are not in the line-of-fire but are nearby (within an estimated 3 meters from the firing device), the device will again refuse to fire. Assuming these conditions are not met, the device will be free to operate normally and eject a projectile as intended.

Figure 7:
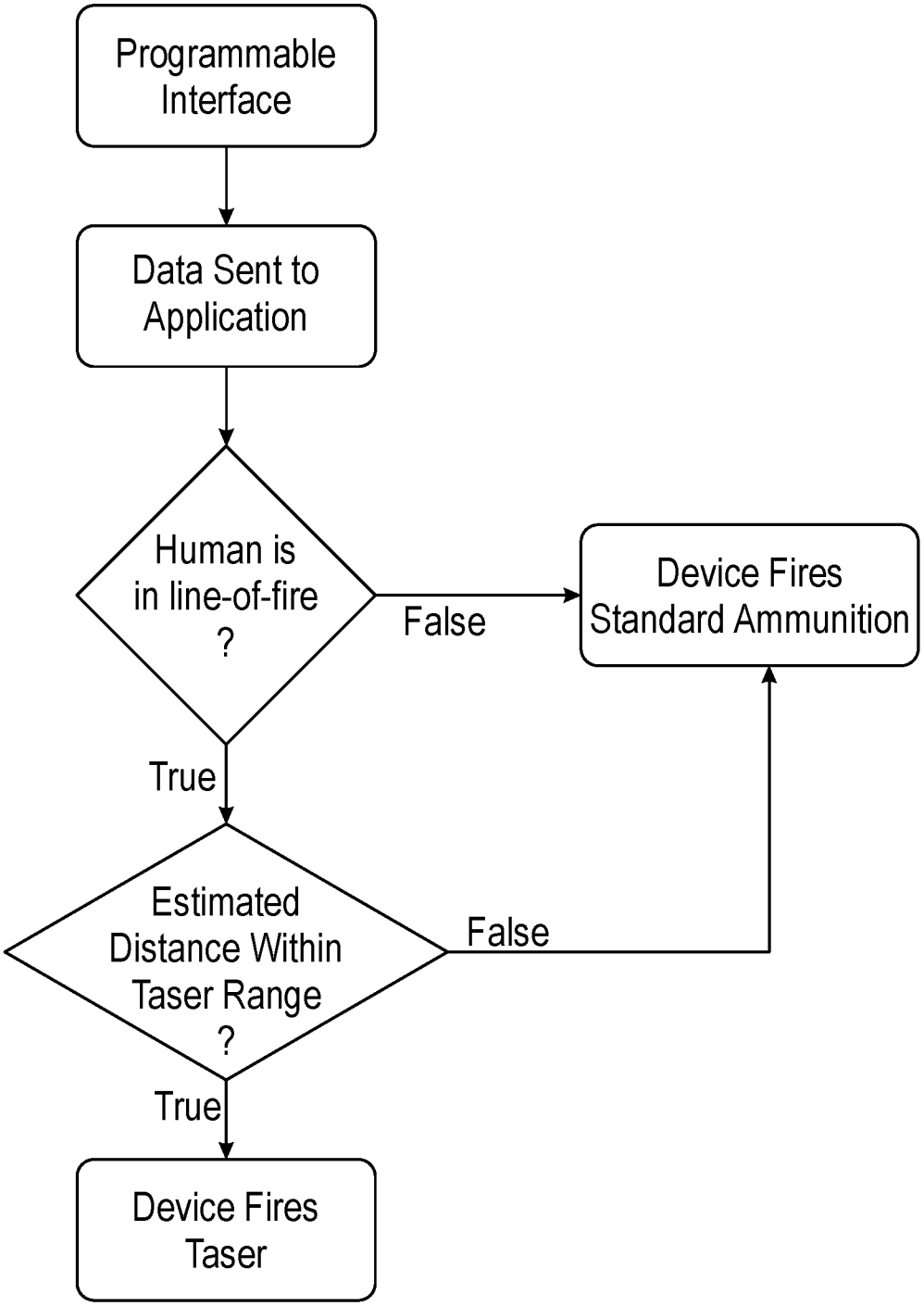
FIG. 7 is an example flowchart for implementation for a taser.

FIG. 7 illustrates another example application for use in a taser. In this example application, a firing device may be capable of firing both a standard ammunition and a taser. If there is a human in the line-of-fire and the estimated distance is within range of the equipped taser then the non-lethal option would be selected instead.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A firing system comprising:

a computing device configured to be fitted onto a firearm or into the firearm, wherein the computing device has one or more processing units;

one or more environmental input devices in communication with the computing device;

an activation mechanism in communication with the computing device, wherein either the activation mechanism is activated to fire a propellant on a cartridge to propel a bullet from the firearm or the activation mechanism is deactivated in response to an electronic signal sent from the computing device;

a programmable interface in communication with the computing device, wherein a set of operations including a series of variables are inputted into the programmable interface as an application for the one or more processing units in the computing device to communicate with the activation mechanism; and one or more machine learning processes, utilized by the computing device, trains the computing device ahead of time to recognize and respond to environmental factors according to the set of operations pre-programmed through the programmable interface, wherein the environmental factors include body parts, and wherein images used to train the computing device are annotated as body parts leading to a fatal shot and body parts leading to a non-fatal shot.

2. The firing system of claim 1, wherein the computing device further trains to recognize and respond to alternative environmental factors, wherein the alternative environmental factors are chosen from a list of factors including distance, target age, and number of targets.

3. The firing system of claim 1, wherein the one or more environmental input devices comprise one or more cameras or one or more sensor devices, wherein the one or more environmental input devices are mounted on the firearm.

4. A method for using a firing system, the method comprising:

receiving an activation signal, by a computing device, from a trigger mechanism on a firearm, wherein the computing device is configured to be fitted onto the firearm or into the firearm;

capturing one or more environmental inputs by one or more environmental input devices, wherein the one or more environmental inputs are of a target in a line of fire of the firearm;

communicating the one or more environmental inputs to the computing device; and processing the one or more environmental inputs by the computing device and determining whether an activation mechanism is to be activated or deactivated by processing a set of operations which includes a series of variables inputted into a programmable interface in communication with the computing device, wherein one or more machine learning processes utilized by the computing device trains the computing device ahead of time to recognize and respond to environmental factors according to the set of operations pre-programmed through the programmable interface, wherein the environmental factors include body parts, and wherein images used to train the computing device are annotated as body parts leading to a fatal shot and body parts leading to a non-fatal shot; and wherein the activation mechanism responds to an electronic signal from the computing device by either activating to fire a propellant on a cartridge to propel a bullet from the firearm or deactivating to prevent the bullet from being expelled from the firearm.

5. The method of claim 4, further comprising: sending the electronic signal from the computing device to the activation mechanism to either activate or deactivate the activation mechanism.

6. The method of claim 4, further comprising: sending the electronic signal from the computing device to the activation mechanism to fire an alternative shot.

7. A firing system comprising:

a computing device, having one or more processing units, wherein the computing device is configured to be fitted onto a firearm or into the firearm;

one or more cameras in communication with the computing device;

one or more sensors in communication with the computing device;

an activation mechanism in communication with the computing device, wherein the one or more processing units sends a first signal to the activation mechanism to activate the activation mechanism or deactivate the activation mechanism;

a programmable interface, in communication with the computing device, wherein a set of operations including a series of variables are inputted into the programmable interface as an application for the one or more processing units in the computing device to communicate with the activation mechanism; and one or more machine learning processes, utilized by the computing device, trains the computing device ahead of time to recognize and respond to environmental factors according to the set of operations pre-programmed through the programmable interface, wherein the environmental factors include body parts, and wherein images used to train the computing device are annotated as body parts leading to a fatal shot and body parts leading to a non-fatal shot.

8. The firing system of claim 7, wherein the first signal activates the activation mechanism such that a propellant is fired on a cartridge to propel a bullet from the firearm.

9. The firing system of claim 7, wherein the computing device is connected by a five-volt positive signal to a trigger on the firearm.

10. The firing system of claim 7, wherein the one or more cameras and the one or more sensors are mounted on the firearm in a position to capture a line of sight of the firearm.

11. The firing system of claim 7, wherein the one or more processing units receives first content from the one or more cameras and the one or more sensors.

12. The firing system of claim 11, wherein the one or more processing units aggregates the first content into a single memory-mapped file accessible by the programmable interface.

13. The firing system of claim 12, wherein the one or more processing units receives second content that comprises information about and/or images of humans and body parts thereof at various ages and/or various distances.

14. The firing system of claim 13, wherein the one or more processing units trains, during a machine learning mode, to recognize the humans and the body parts thereof.

15. The firing system of claim 14, wherein the one or more processing units classifies the second content, wherein the second content is annotated as the body parts that would be fatal if shot and the body parts that would be non-fatal if shot.

16. The firing system of claim 15, wherein the one or more processing units identifies one or more objects in the first content.

17. The firing system of claim 16, wherein the one or more processing units compares the first content to the second content to determine or predict an outcome as to whether the one or more objects in the first content will be hit or have a more likely than not probability of being hit with a bullet exiting the firearm.

18. The firing system of claim 17, wherein the one or more processing units determines whether, in response to the comparison, to send the first signal to activate the activation mechanism or deactivate the activation mechanism.

19. The firing system of claim 7, wherein the computing device is retrofitted to the firearm.

* * * * *